US007009486B1

(12) United States Patent
Goeke et al.

(10) Patent No.: US 7,009,486 B1
(45) Date of Patent: Mar. 7, 2006

(54) LOW NOISE POWER TRANSFORMER

(75) Inventors: Wayne Goeke, Hudson, OH (US); Art Sypen, Newbury, OH (US)

(73) Assignee: Keithley Instruments, Inc., Cleveland, OH (US)

( * ) Notice: Subject to any disclaimer, the term of this patent is extended or adjusted under 35 U.S.C. 154(b) by 40 days.

(21) Appl. No.: 10/666,975

(22) Filed: Sep. 18, 2003

(51) Int. Cl.
*H01F 27/28* (2006.01)

(52) U.S. Cl. ..... 336/229

(58) Field of Classification Search ..... 336/65, 336/83, 84 R, 84 C, 192, 200, 229, 232
See application file for complete search history.

(56) References Cited

U.S. PATENT DOCUMENTS 3,453,574 A * 7/1969 Parry ..... 336/182
3,898,595 A * 8/1975 Launt ..... 335/152
4,342,976 A * 8/1982 Ryser ..... 336/84 C
4,536,733 A * 8/1985 Shelly ..... 336/182
4,755,783 A * 7/1988 Fleischer et al. ..... 336/84 C
4,777,465 A * 10/1988 Meinel ..... 336/65
5,543,773 A * 8/1996 Evans et al. ..... 336/183
5,966,294 A * 10/1999 Harada et al. ..... 361/794
6,188,305 B1 * 2/2001 Chang et al. ..... 336/200

* cited by examiner

*Primary Examiner*—Tuyen T Nguyen
(74) *Attorney, Agent, or Firm*—Pearne & Gordon LLP

(57) ABSTRACT

A printed circuit board transformer has primary and secondary windings. The transformer includes a printed circuit board having a plurality of traces forming a plurality of first portions of the primary and secondary windings, an annular magnetic core adjacent to the printed circuit board, and a plurality of second portions of the primary and secondary windings. The second portions are formed from conductors enlacing the core.

6 Claims, 8 Drawing Sheets

LOW NOISE POWER TRANSFORMER

BACKGROUND OF THE INVENTION

The present invention relates to low noise transformers and, in particular, to transformers with low common mode noise.

In sensitive measurement equipment, the power transformer is often used to provide isolation from the measurement circuit. An unwanted common mode current from the transformer can easily corrupt or even obscure the electrical parameter to be measured.

Bulky transformers with expensive internal shields are commonly used to limit the common mode current to acceptable noise levels.

An inexpensive, compact, transformer with the desired characteristics would permit a less expensive and more compact measurement instrument to be produced.

SUMMARY OF THE INVENTION

A printed circuit board transformer has primary and secondary windings. The transformer includes a printed circuit board having a plurality of traces forming a plurality of first portions of the primary and secondary windings, an annular magnetic core adjacent to the printed circuit board, and a plurality of second portions of the primary and secondary windings. The second portions are formed from conductors enlacing the core.

DESCRIPTION OF THE PREFERRED EMBODIMENTS

Figure 2:
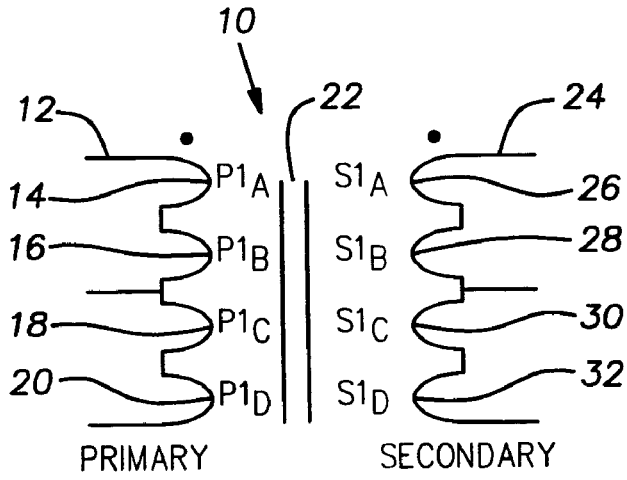
FIG. 2 is a schematic diagram of the transformer of FIG. 1.

Referring to FIG. 2, a transformer 10 is shown schematically with a center-tapped primary winding 12 formed from the turns 14, 16, 18, 20. A magnetic core 22 couples the winding 12 to the center-tapped secondary winding 24 formed from the turns 26, 28, 30, 32.

Figure 1:
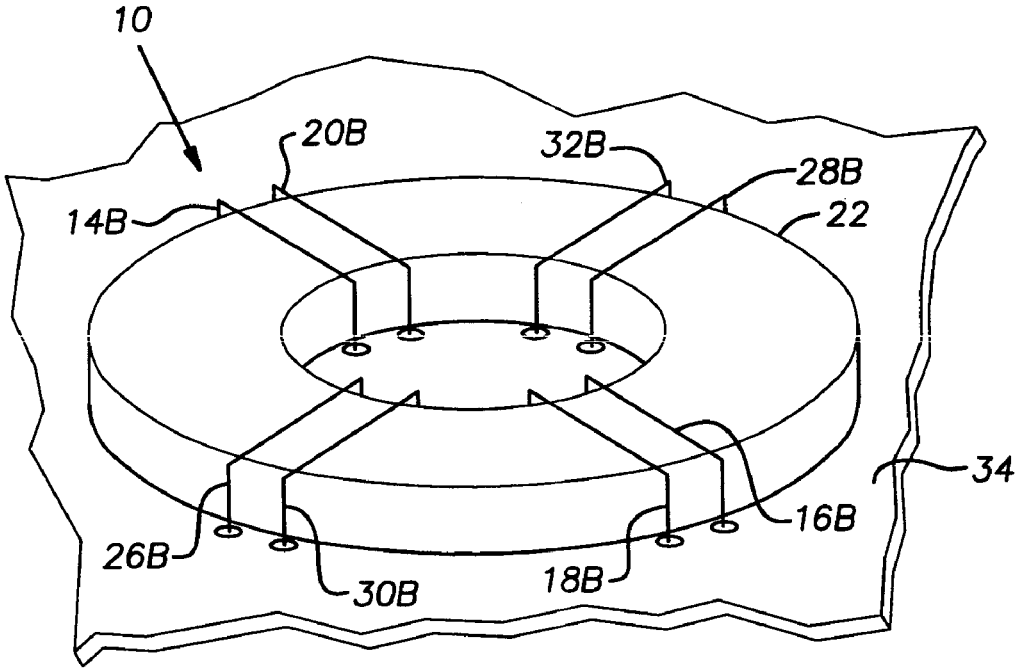
FIG. 1 is a perspective view of a transformer according to the invention.
Figure 3:
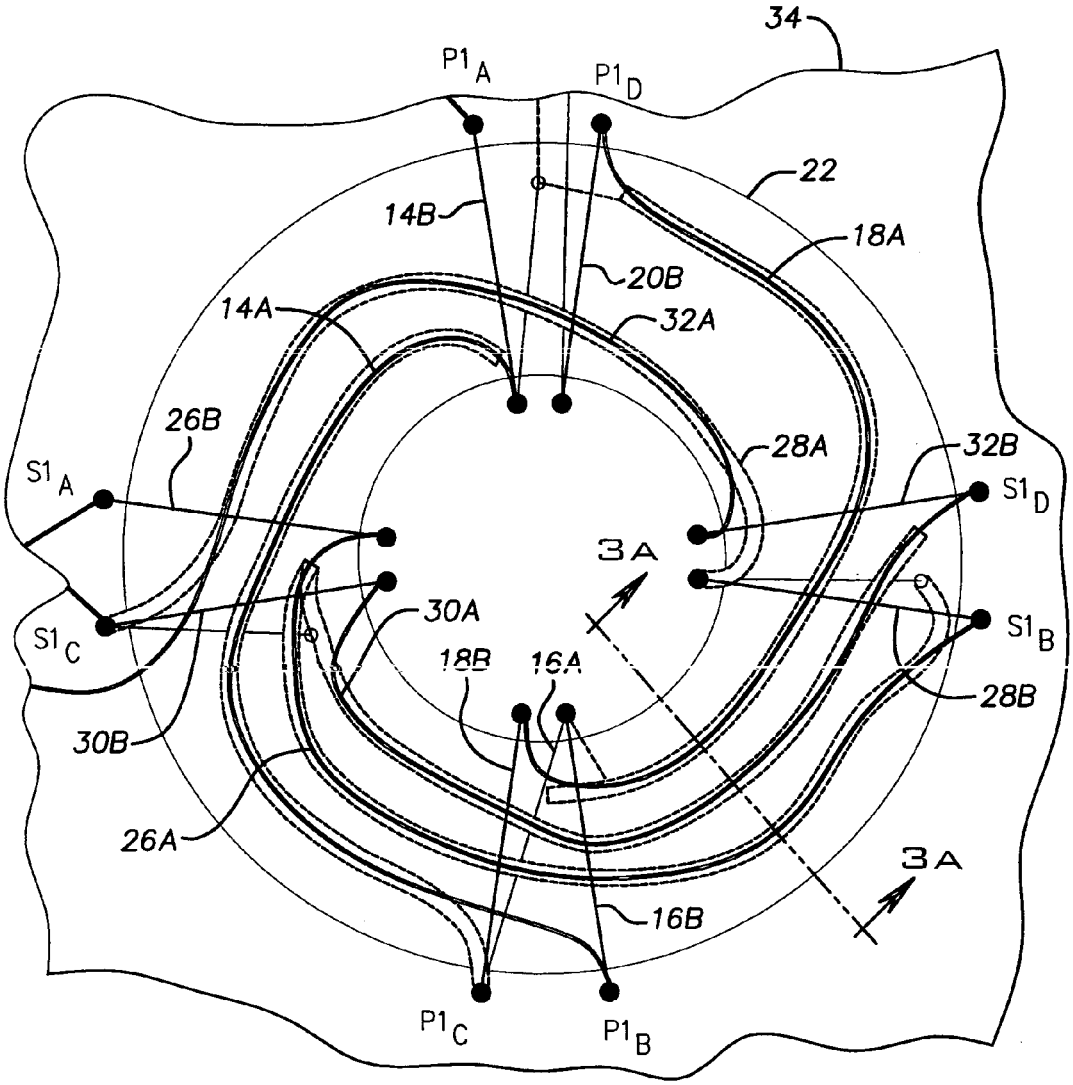
FIG. 3 is a top x-ray view of the transformer of FIG. 1.

Referring to FIGS. 1 and 3, the transformer 10 may be advantageously implemented with an annular magnetic core 22; a printed circuit board 34 containing traces 14A, 16A, 18A, 20A forming first portions of the winding 12, and traces 26A, 28A, 30A, 32A forming first portions of the winding 24; and staple-like conductors staples 14B, 16B, 18B, 20B forming second portions of the winding 12 and staples 26B, 28B, 30B, 32B forming second portions of the winding 24.

The core 22' is enlaced by the staples 14A, 16B, 18B, 20B, 26B, 28B, 30B, 32B when they are electrically and mechanically connected to the board 34, for example, by soldering.

Figure 3A:
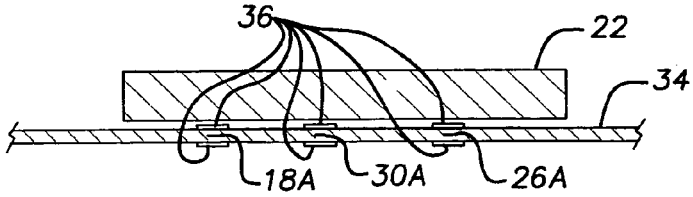
FIG. 3A is a cross sectional view along the line 3A.

The board 34 may advantageously be of a multilayer type with for example, (see FIG. 3A) a conductor (e.g., trace 26A) shielded above and below by a wider conductor (e.g., traces 36) more fully explained below. The traces may be, for example, twice as wide as the sandwiched trace.

Many power applications draw large current from only one polarity of a power supply at a time. As a result, the large current flow in the secondary of a transformer flows in the winding in the winding above the center tap for one half of the transformer's input cycle and flows in the winding below the center tap for the other half of the input cycle. Similarly, it is common to drive a transformer's primary using a push-pull circuit. This results in current flowing only in the winding above the primary's center tap for the first half of the push-pull cycle and then flowing in the winding below the center tap during the other half of the push-pull cycle.

The transformer 10 takes this into account to minimize leakage inductance. The staple 14B and the staple 16B; the staple 26B and the staple 28B; the staple 18B and the staple 20B; and the staple 30B and the staple 32B are located on opposite sides of the transformer 10. By using this symmetrical arrangement of the staples, the mutual inductances between turns that are carrying large currents at the same time are reduced.

Displacement current (for example, parasitic capacitive leakage) between the primary and secondary winding is another source of common mode current/noise.

By locating primary staples adjacent to corresponding secondary staples, adjacent staples are electrically moving in the same direction at the same time, thus minimizing displacement current. For example, staple 14B is adjacent staple 26B, staple 16B is adjacent staple 28B, staple 18B is adjacent staple 30B, and staple 20B is adjacent staple 32B.

Typically, the center taps of the transformer are static with respect to the transformer signals and therefore to not couple common mode current. This advantageously allows the wide traces 36 to be added to the board 34 above and below electrically moving traces. All of the traces 36 are connected to the either the primary or the secondary center tap. The traces 36 can act as either an electrostatic shield or a ground return, further improving the performance of the transformer 10.

Figure 4A:
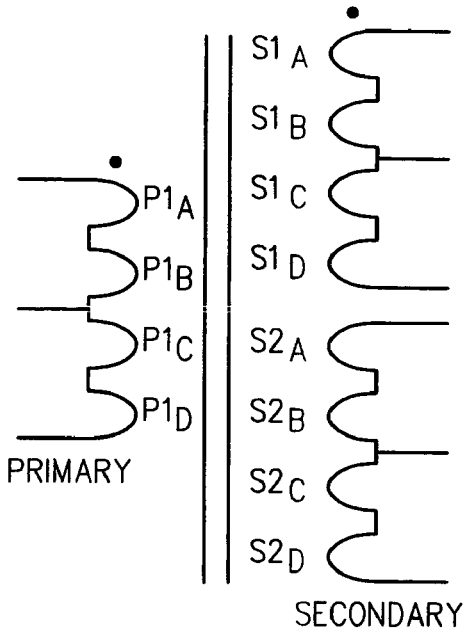
FIG. 4A is a schematic diagram of another transformer.
Figure 4B:
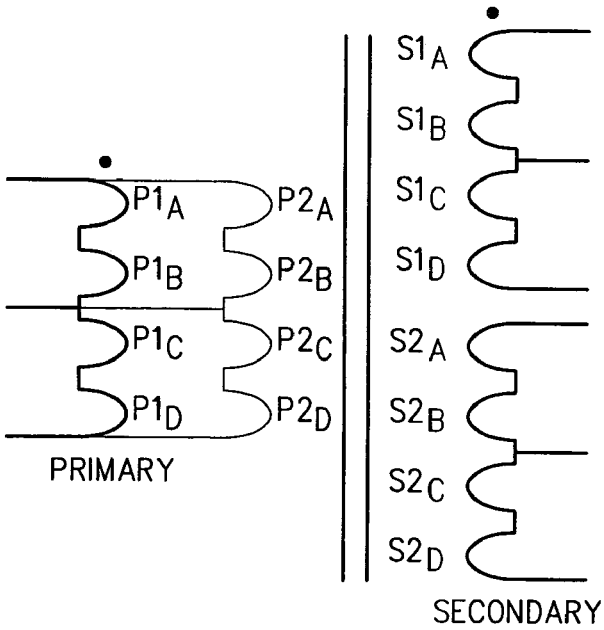
FIG. 4B is a schematic diagram of the transformer of FIG. 4A modified for use in another transformer according to the invention.

Referring to FIG. 4A, a transformer has a set of primary windings and two sets of secondary windings. In order to take advantage of the design techniques described above, a second set of primary windings in parallel can be used as shown in the transformer 10' of FIG. 4B.

Then it is possible for the staples to be symmetrically spaced about the core so that staples carrying large currents are symmetrically spaced away from each other and corresponding primary and secondary staples are located adjacent to each other.

Figure 5:
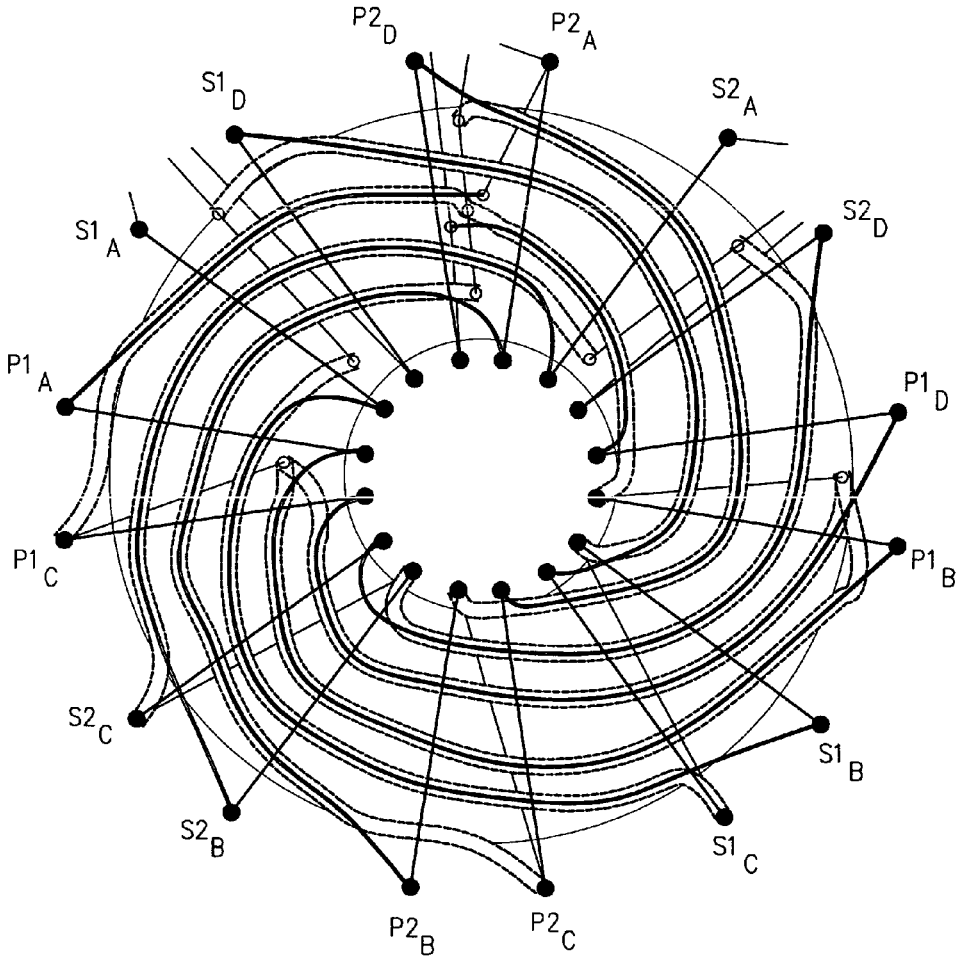
FIG. 5 is a top x-ray view of a transformer based on FIG. 4B according to the invention.

FIG. 5 illustrates an embodiment of the transformer 10' incorporating the above considerations, as well as electrostatic shielding of moving traces.

If the winding halves each have two windings, the spacing for each turn of the winding half is 180 degrees. Similarly, it is 120 degrees for three turns, 90 degrees for four turns, and so on.

Figure 6:
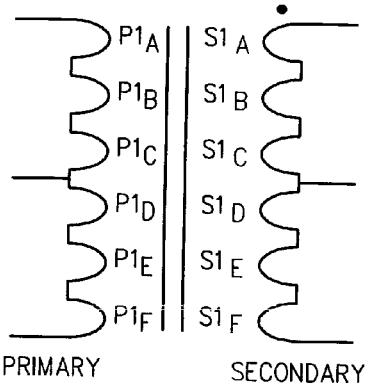
FIG. 6 is a schematic diagram and x-ray view of an additional transformer according to the invention.
Figure 6:
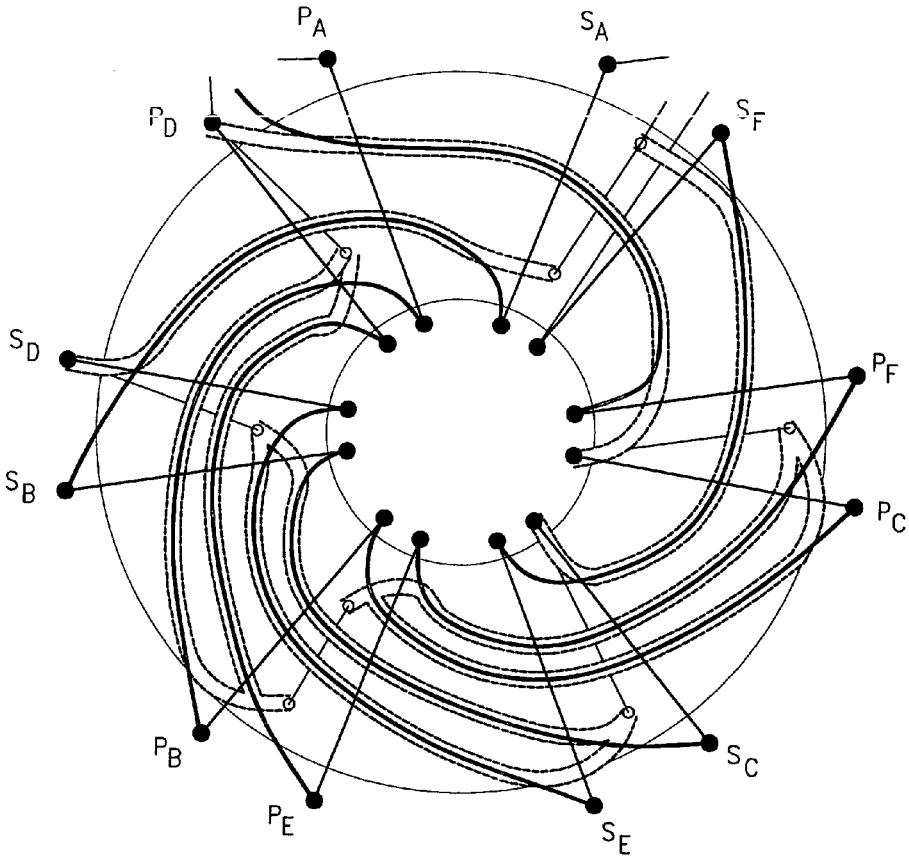

FIG. 6 shows both a schematic and an embodiment of a transformer 10" having three turns in each winding half.

In general, transformer leakage is minimized by reducing the mutual inductance between turns within a winding and by increasing the mutual inductance between the primary and secondary turns. This suggests other configurations for improved performance transformers.

Figure 7:
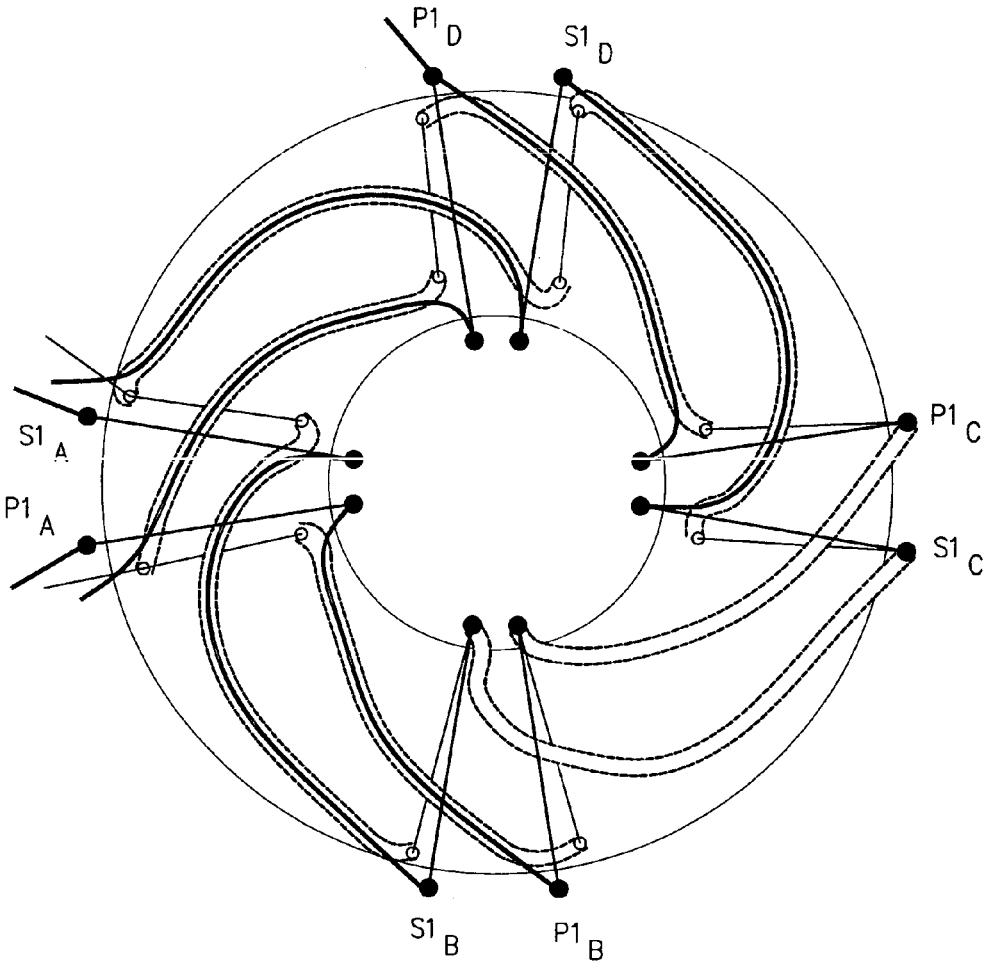
FIG. 7 is a top x-ray view of still another transformer according to the invention.

FIG. 7 is basically a bifiler winding of the primary and secondary windings of a transformer 50. The printed circuit board, annular core, staple, shielded trace construction described above is employed, but the primary and secondary turns are arranged to be respectively adjacent.

Figure 8:
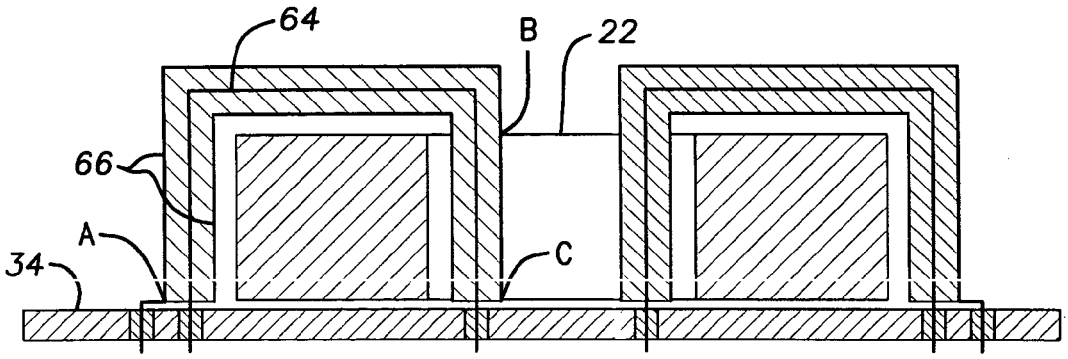
FIG. 8 is a cross sectional view showing the coaxial staples in a transformer according to the invention.

Referring to FIG. 8, further reduction in common mode current can be achieved by replacing the staples with coaxial conductors 62. The inner conductor 64 is connected according to the prior descriptions and the outer conductor 66 is connected at one end to the center-tap or other reference. If the outer connector is connected at the outside of the core 22, the outer conductor 66 will be at the center-tap voltage except at the inside of the core 22. All of the staples having shield that are moving the same reduces sensitivity to the symmetry of the staple placement.

From the points A to B, the voltage on the outer conductor 66 is at the center-tap voltage. The point C is moving about the center-tap voltage plus and minus the volts/turn of the transformer.

Using coaxial staples allows more freedom regarding which turns are next to each other. As the turns ratio of the transformer increases, limiting common mode signals becomes more of a problem. The exact symmetry of the placement of plain staples becomes more important. By using coaxial staples, the exact orientation of the staple becomes less important. The design can then tolerate more bent or misaligned staples.

Figure 9:
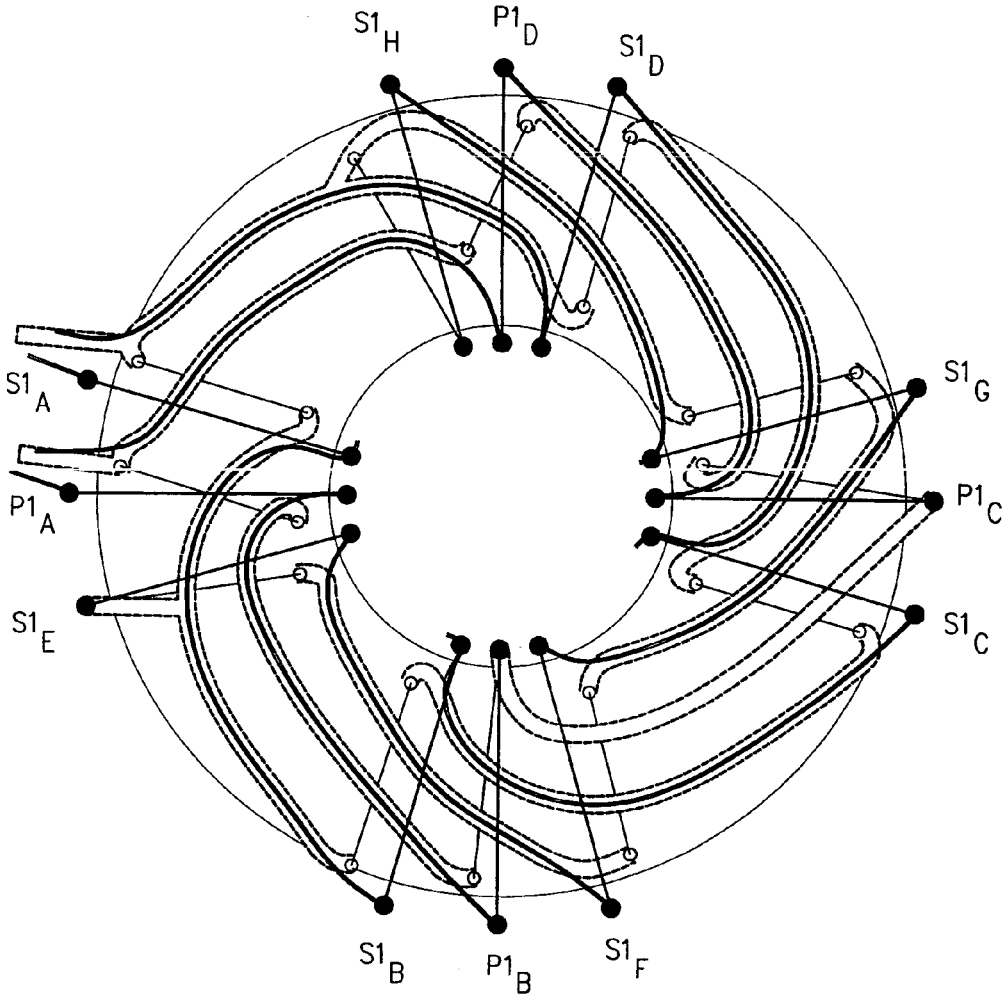
FIG. 9 is a top x-ray view of another additional transformer according to the invention.

FIG. 9 shows a 1:2 turns ratio transformer. It may be constructed using coaxial staples. An alternative to using coaxial staples is to add additional turns to the primary winding so the turns ratio is one as in the previous designs, but without driving the additional turns.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A printed circuit board transformer having primary and secondary windings, said transformer comprising:

a printed circuit board having a plurality of traces forming a plurality of first portions of said primary and secondary windings;

an annular magnetic core adjacent to said printed circuit board; and a plurality of primary second portions of said primary windings and a plurality of secondary second portions of said secondary windings, said second portions being formed from conductors enlacing said core, wherein said primary second portions and said secondary second portions are each arranged in diametric pairs about said core.

2. A transformer according to claim 1, wherein said second portions are symmetrically spaced about said core.

3. A transformer according to claim 1, wherein each primary second portion is adjacent to a corresponding secondary second portion.

4. A transformer according to claim 1, wherein the trace of a first portion is electrically shielded by a trace in another layer of said printed circuit board.

5. A transformer according to claim 1, wherein the trace of a first portion is provided with a ground return by a trace in another layer of said printed circuit board.

6. A transformer according to claim 1, further comprising a coaxial conductor having an internal and an external conductor, said internal conductor corresponding to one of said second portions and said external conductor being connected at one end of said external conductor to a reference potential.

* * * * *

UNITED STATES PATENT AND TRADEMARK OFFICE

CERTIFICATE OF CORRECTION

PATENT NO. : 7,009,486 B1
APPLICATION NO. : 10/666975
DATED : March 7, 2006
INVENTOR(S) : Wayne Goeke et al.

It is certified that error appears in the above-identified patent and that said Letters Patent is hereby corrected as shown below:

In the claims, please delete claim 2, column 4, lines 22 and 23.

Signed and Sealed this

Eighteenth Day of August, 2009

David J. Kappos

David J. Kappos
*Director of the United States Patent and Trademark Office*